US005277310A

United States Patent [19]

Mertz

[11] Patent Number: 5,277,310

[45] Date of Patent: Jan. 11, 1994

[54] COMPOSITE APPLIANCE PACKAGE

[75] Inventor: Noel J. Mertz, Geneva, Ill.

[73] Assignee: Container Corporation of America, Clayton, Mo.

[21] Appl. No.: 902,850

[22] Filed: Jun. 23, 1992

[51] Int. Cl.[5] ..... B65D 81/02

[52] U.S. Cl. ..... 206/320; 206/497; 206/586; 206/594; 229/23 R; 229/125.19; 229/918

[58] Field of Search ..... 206/320, 497, 453, 586, 206/591, 593, 594; 229/23, 229/23, 125.19, 918, DIG. 1

[56] References Cited

U.S. PATENT DOCUMENTS 3,504,842 4/1970 Grafslund ..... 206/320 X
3,891,086 6/1975 Isaacs ..... 206/320
4,811,840 3/1989 Muyskens ..... 206/320
5,161,692 11/1992 Knierim ..... 206/320 X

*Primary Examiner*—Steven N. Meyers
*Assistant Examiner*—Jacob K. Ackun, Jr.
*Attorney, Agent, or Firm*—Richard W. Carpenter

[57] ABSTRACT

A composite shipping container for packaging, heavy articles and appliances such kitchen ranges. The package includes upper and lower structures interconnected by hollow corner posts and wrapped with plastic film and strapping. The lower structure of the container includes a base member adapted to be attached to a lower portion of the article and bottom corner members attached to the corner posts and to the base members, but which are severable from each other to allow the temporary partial removal of the appliance from the package and its reinsertion without destroying the integrity of the package.

8 Claims, 6 Drawing Sheets

COMPOSITE APPLIANCE PACKAGE

BACKGROUND OF THE INVENTION

1. Field of the Invention

This invention relates to composite packages of the type used for the packaging of heavy articles, such as kitchen ranges, and more particularly to a composite package from which a packaged article can be temporarily removed and thereafter reinserted without destroying the integrity of the package.

2. Description of Background Art

A background art search directed to the subject matter of this application and conducted in the United States Patent and Trademark Office disclosed the following U.S. Pat. Nos.

| | | | |
|---|---|---|---|
| 3,504,842 | 3,648,959 | 3,666,164 | 3,675,675 |
| 3,891,086 | 3,907,241 | 3,934,805 | 3,992,849 |
| 4,226,327 | 4,224,471 | 4,331,234 | 4,378,743 |
| 4,390,154 | 4,467,004 | 4,502,597 | 4,762,226 |
| 4,771,893 | 4,792,325 | 4,798,294 | 4,811,840 |
| 4,865,201 | 4,881,641 | 4,919,263 | 4,947,619 |
| 4,969,307 | 4,986,418 | | |

None of the patents uncovered in the search discloses a composite appliance package comprising paperboard internal components with an outer film overwrap, which package can accommodate the temporary removal of the appliance and its subsequent reinsertion into the package without destroying the integrity of the package.

SUMMARY OF THE INVENTION

It is a primary object of the present invention to provide an improved composite package for the packaging of heavy articles such as kitchen ranges.

A more specific object of the invention is the provision of a composite appliance package that comprises a plurality of paperboard internal components which are secured in position against the appliance by an outer layer of plastic film.

An even more specific object of the invention is the provision of a package of the type described which is adapted to permit the temporary partial removal of the appliance from and its reinsertion into the package, so the appliance can be altered while it is temporarily out of the package.

These and other objects of the invention will be apparent from the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
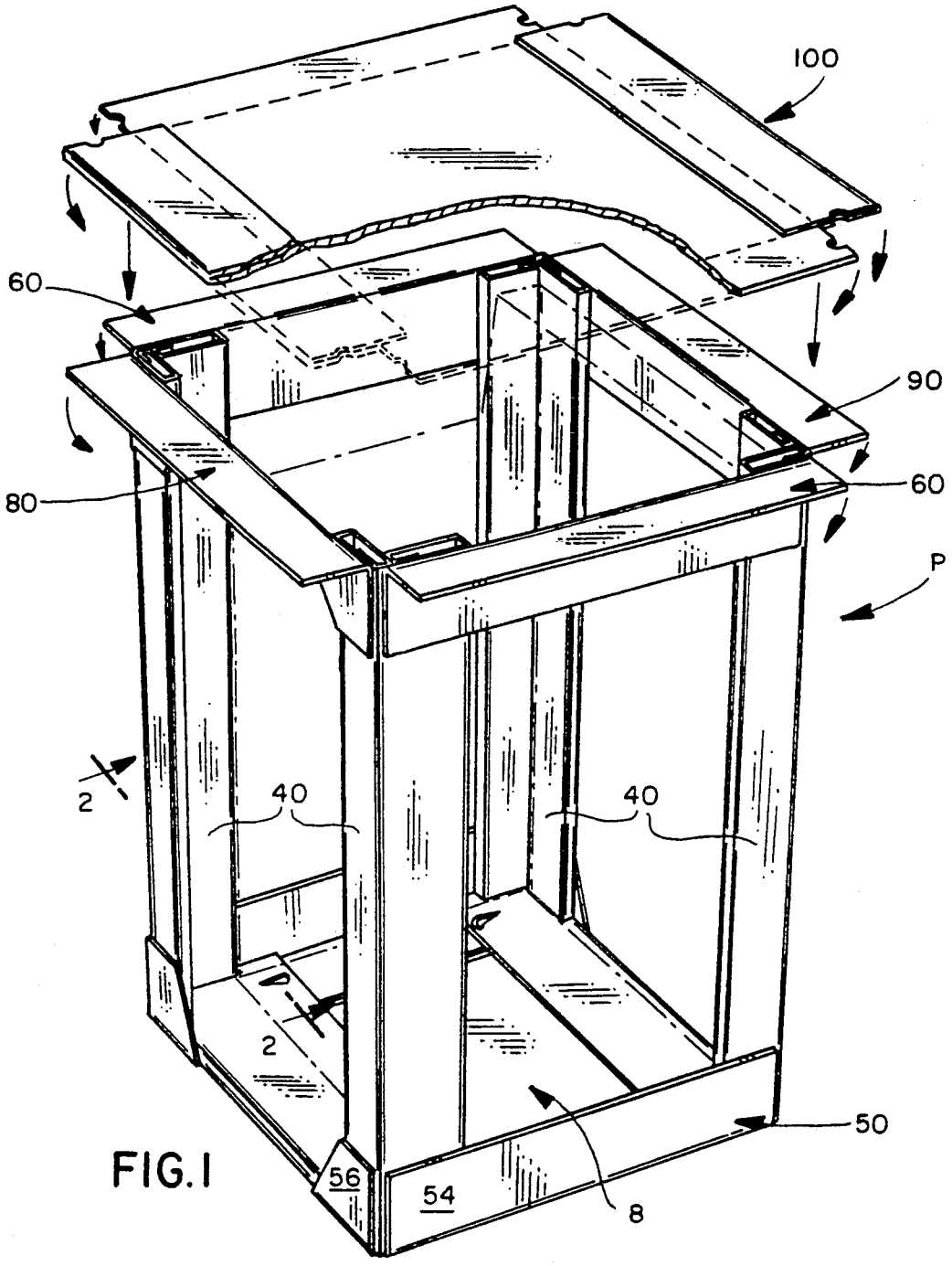
FIG. 1 is a fragmentary isometric view of a composite appliance package embodying features of the present invention, shown without the packaged article and before the upper end of the package has been closed.
Figure 2:
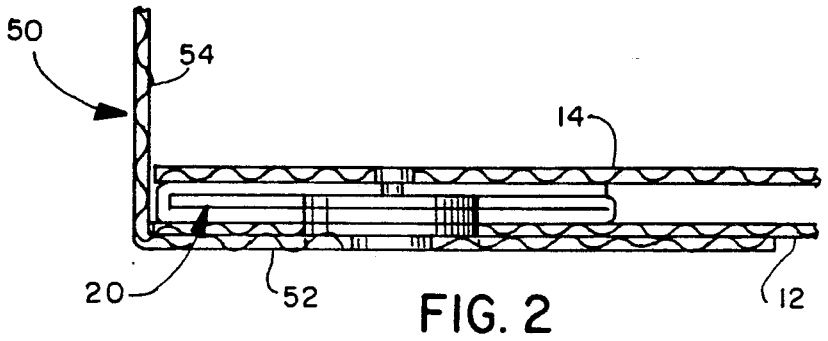
FIG. 2 is a fragmentary vertical cross-section taken on line 2—2 of FIG. 1.
Figure 3:
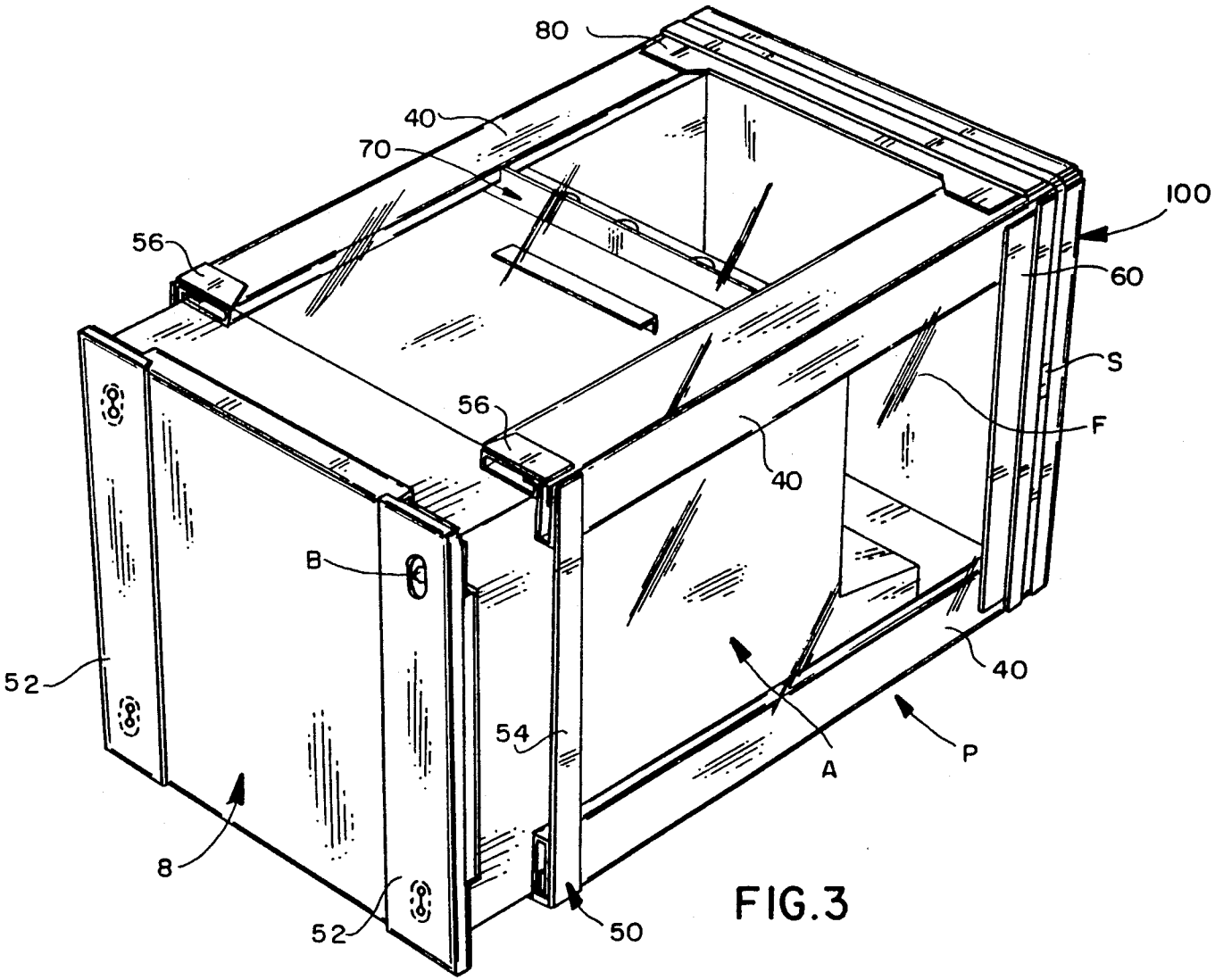
FIG. 3 is a view similar to that of FIG. 1, but shown after the upper end of the package has been closed and with the article shown partly removed from the package.
Figure 4:
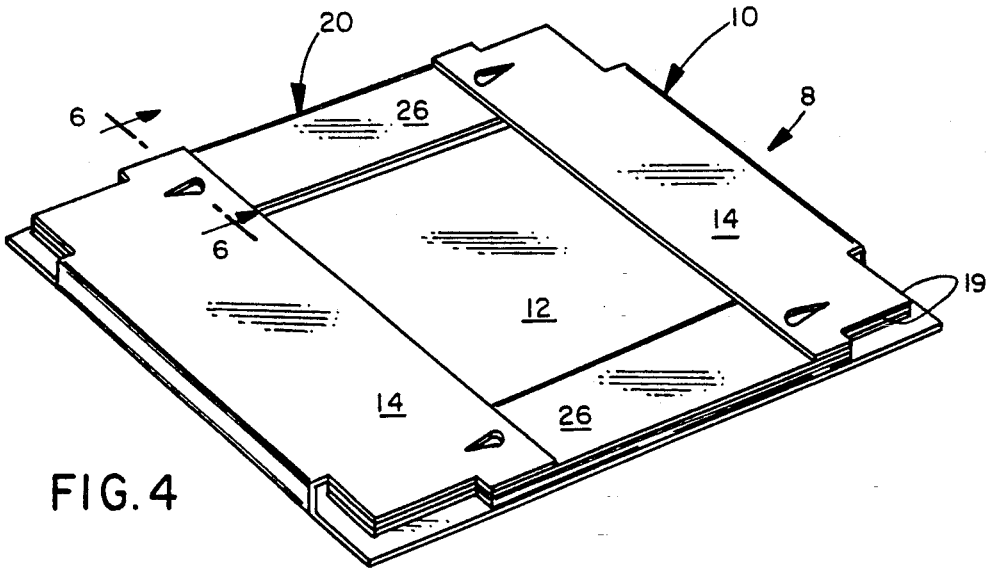
FIG. 4 is a fragmentary isometric view of the base member of the package illustrated in the previous views.

Referring now to FIGS. 1 and 3, this invention relates to a composite package, indicated generally at P, of the type generally used for the packaging of heavy articles or appliances such as kitchen ranges.

As best seen in FIG. 3, package P comprises internal components that include upper and lower structures and corner posts, all of which are preferably formed from foldable sheet material, such as paperboard, and which are held securely in place against the packaged article A by an overwrap of plastic film and strapping.

The lower structure, which is adapted to support the packaged article A, includes a multi-piece base member 8 having a first section 10 and a pair of second sections 20.

Figure 7:
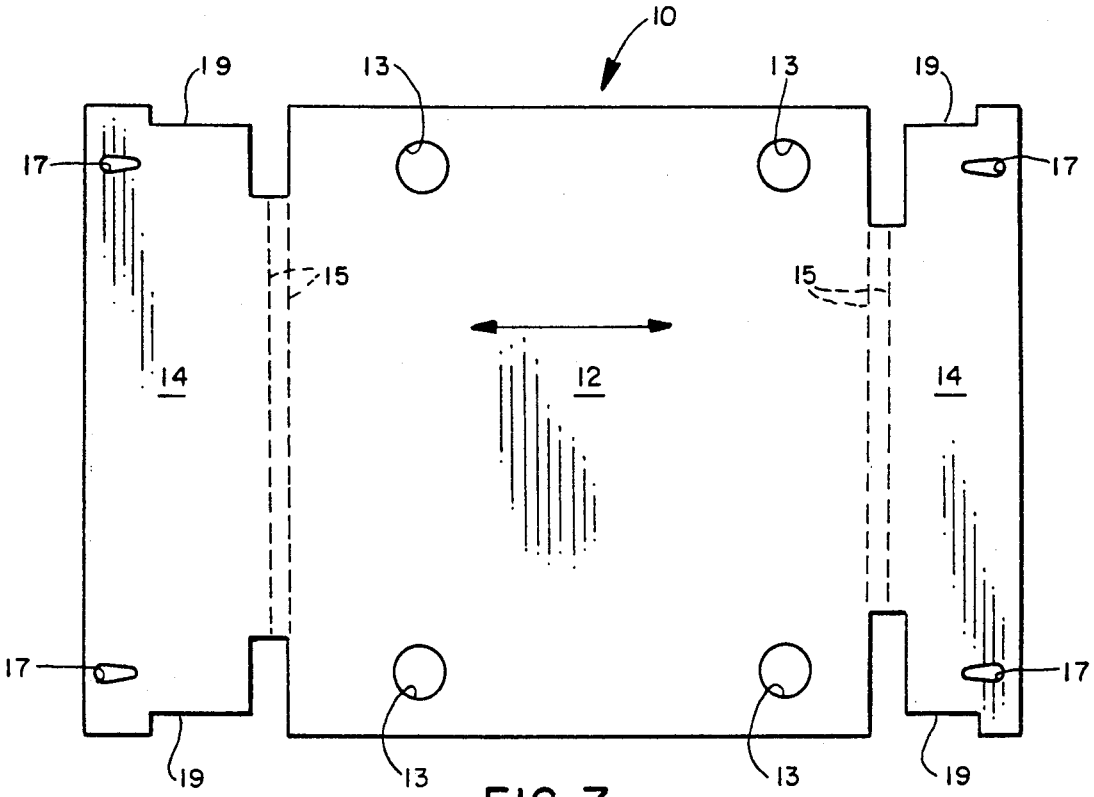
FIGS. 7 and 8 are plan views of the blanks of sheet material from which the base member sections illustrated in FIG. 5 may be formed.

As best seen in FIG. 7, base member first section 10 includes a generally rectangular center panel 12 through which extend a plurality of holes 13 located adjacent the corners of the center panel.

First section 10 also includes a pair of side panels 14 which are foldably joined to opposed sides of center panel 12 along preferably double scored fold lines 15. Side panels 14 have, adjacent the ends thereof, recesses or depressions 17, the purpose of which is to receive portions of the package article.

Also, as best seen in FIG. 7, certain corners of the side panels 14 are provided with generally L-shaped recesses 19, the purpose of which is hereinafter described.

Figure 8:
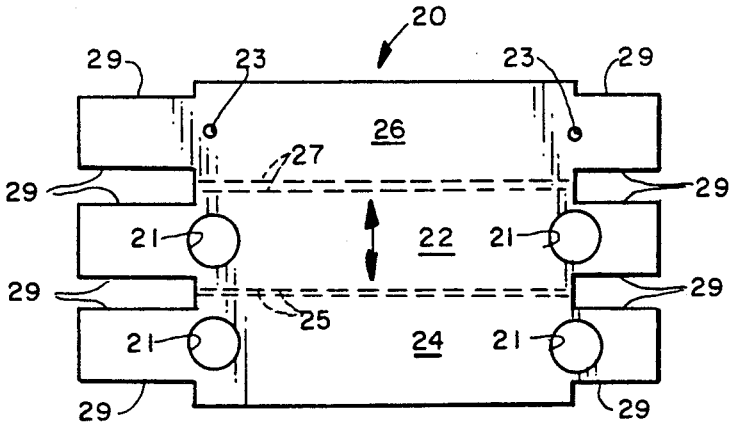

As best seen in FIG. 8, each base member second section 20 includes a generally rectangular lower panel 22 and also a pair of generally rectangular intermediate and upper panels 24 and 26 which are foldably joined to opposite sides of lower panel 22 on preferably double scored fold lines 25 and 27, respectively.

Lower panel 22 and intermediate panel 24 are provided, adjacent their ends, with round openings 21, and upper panel 26 is provided, adjacent its ends, with smaller openings 23. Also, it will be seen that all three of the base member second section panels are provided with generally L-shaped corner recesses 29. The purposes of these openings and recesses are described later in the specification.

Figure 5:
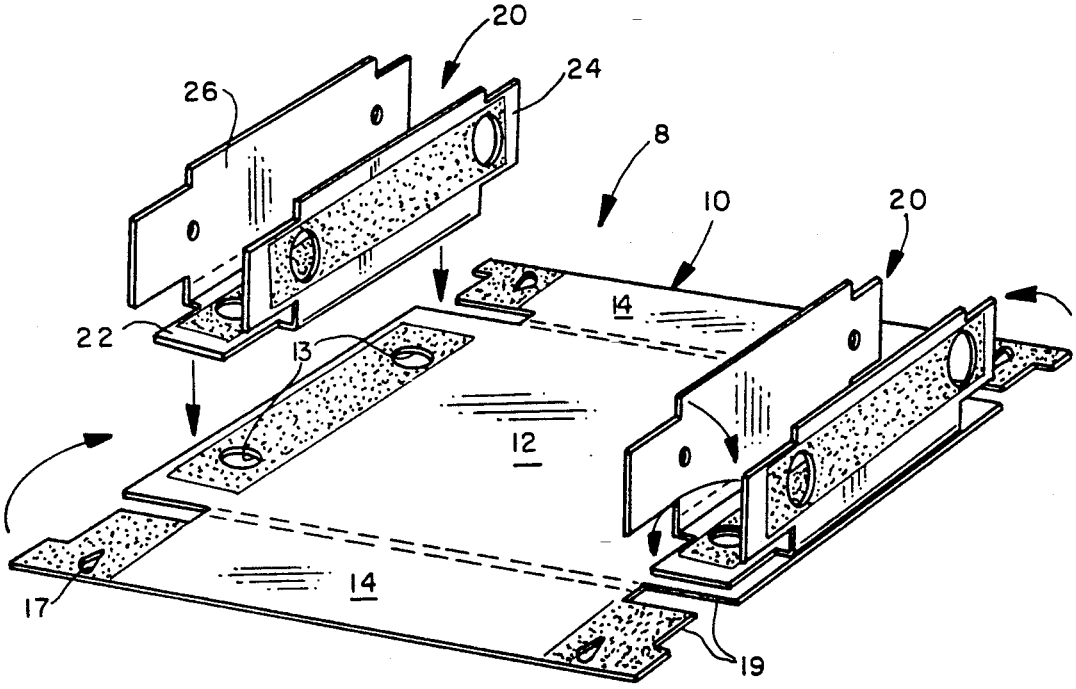
FIG. 5 is an exploded view of the structure illustrated in FIG. 1, shown prior to complete assembly of the base member.
Figure 6:
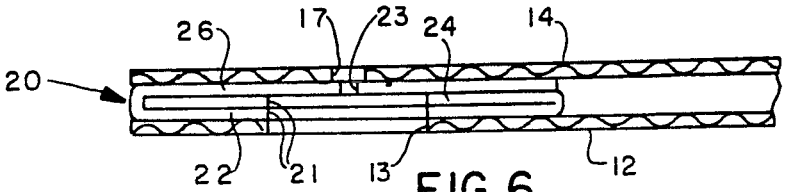
FIG. 6 is a fragmentary vertical section taken on line 6—6 of FIG. 4.

In order to form and assemble the base member, second sections 20 are positioned on the base member first section at opposite ends thereof with the intermediate and upper panels 24 and 26 folded to overlie each other and the base member second section lower panel 22. The panels of the second section may be secured to each other and to the upper surface of the first section 10 by an adhesive, as shown in FIG. 5.

After the base member second sections 20 have been applied to the first section center panel, the first section side panels 14 are folded inwardly 180 degrees to overlie adjacent end portions of second section upper panels 26. They may be secured by adhesive means to the second section upper panels 26.

It will be noted that the corner recesses 19 of the base member first section side panels 14 and the corner recesses 29 of each of the second section panels are all aligned with each other to provide relatively deep L-shaped common openings or recesses adapted to receive lower portions of related corner posts 40.

Extending upwardly from opposite sides of base member 8 are a pair of side members 30, each of which includes a pair of corner posts 40, a bottom corner member 50, and a baseloid flange 60 at the upper end of the side member.

Figure 9:
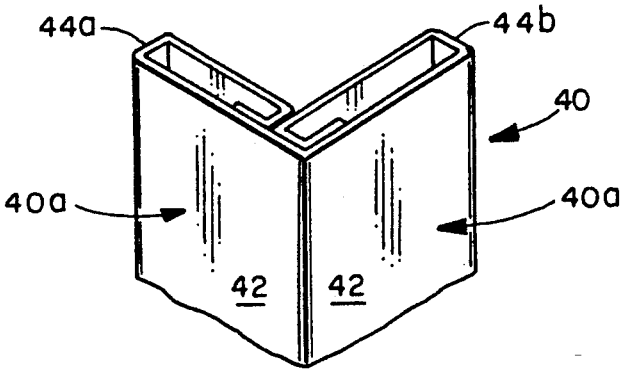
FIG. 9 is a fragmentary isometric view of a portion of one of the corner posts illustrated in the previous views.

As best seen in FIG. 9, each of the corner posts 40 is unique in that it comprises a pair of integral, hollow, sections **40*a***, which are each generally rectangular in cross section and which are disposed at right angles to each other to form a generally L-shaped structure.

Figure 10:
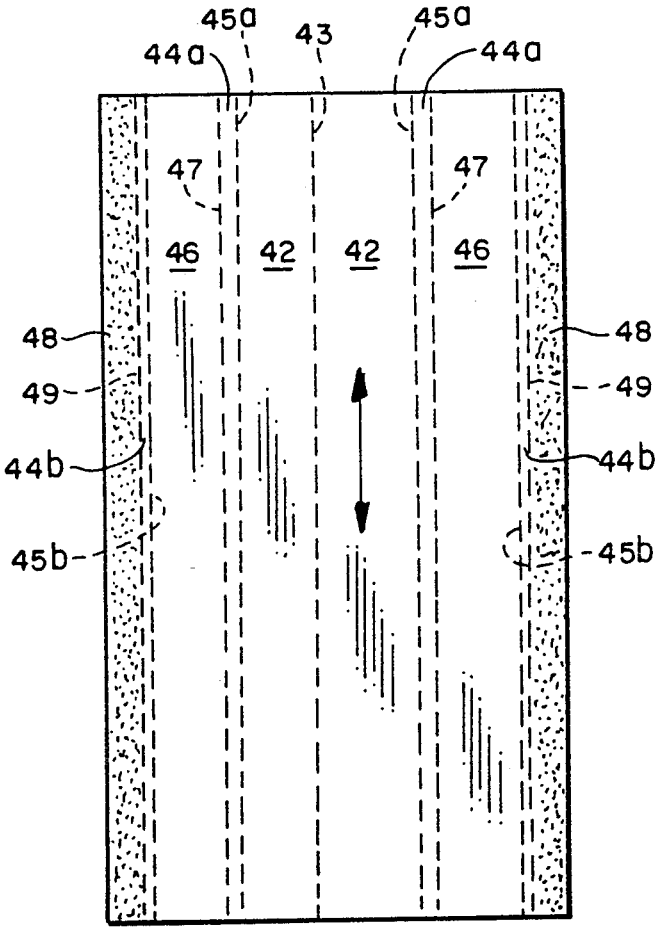
FIG. 10 is a plan view of a blank of sheet material from which the corner posts illustrated in the previous views may be formed.
Figure 10A:
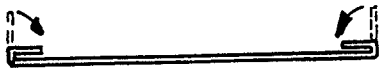
FIGS. 10A, 10B, and 10C are end elevational views showing the folding sequence required to form the corner post of FIG. 9 from the blank of FIG. 10.
Figure 10B:
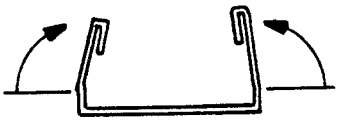
Figure 10C:
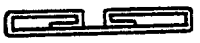

Referring to FIGS. 10–10C, it will be seen that each corner post section **40*a* includes one outer panel 42, foldably joined along a fold line 43 to the outer panel of the other corner post section, a first side panel 44*a*, foldably joined along fold line 45*a* to outer panel 42, an inner panel 46, foldably joined along a fold line 47 to first side panel 44*a*, a second side panel 44*b*, foldably joined along another fold line 45*b* to inner panel 46, and an intermediate panel 48, foldably joined along a fold line 49 to second side panel 44**.

Although in the present application the base members 8 are shown and described in connection with a particular type of composite package, it should be understood that the base members are unique and are equally suitable for use with other types of packages, and may also be used without any other package.

When the panels of corner posts 40 are folded into erected condition, as best seen in FIG. 9, the two rectangular sections **40*a* are positioned at right angles to each other to form an L-shaped structure. The corner posts are mounted on the base member 8**, with their lower portions received within the L-shaped recesses at the four corners of the base member.

Each of the side members 30 also includes a bottom corner member 50 which, as best seen in FIGS. 1 and 3, comprises a bottom panel 52, a side panel 54, foldably joined to one side of the bottom panel along fold line 55, and a pair of end panels 56, foldably joined along fold lines 57 to opposed ends of bottom panel 52 and adapted to be secured to corner posts 40.

Figure 15:
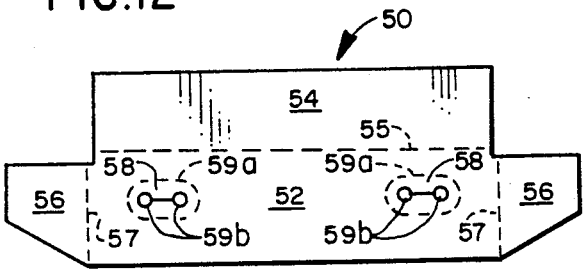
FIG. 15 is a plan view of the blank of sheet material from which the bottom corner members illustrated in the previous views may be formed.

As best seen in FIG. 15, bottom panel 52 includes a pair of detachable tabs 58 defined by perforated lines **59*a*. Each tab 58 has a pair of tool receiving openings 59*b* therein adapted to facilitate removal of the tabs from the bottom panel 52**.

When the side members 30 are formed, each bottom corner member side panel 54 is adhesively secured to lower portions of a pair of related corner posts 40. Later, when bottom corner members 50 are attached to the base member 8, each bottom panel 52 is folded inwardly and adhesively secured to the underside of base member first section center panel 12.

At its upper end, each of the side members 30 includes a transversely extending baseloid flange 60 extending between and adhesively secured to the corner posts 40.

Figure 13:
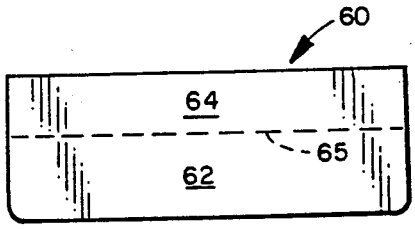
FIG. 13 is a plan view of the blank of sheet material from which the baseloid flanges illustrated in the previous views may be formed.

As best seen in FIGS. 1 and 13, each baseloid flange 60 includes a pair of generally rectangular inner and outer panels 62 and 64, respectively, which are foldably joined to each other along a longitudinally extending fold line 65.

When the side members 30 are formed, the inner panel 62 of each baseloid flange 60 is adhesively secured to side surfaces of a pair of related corner posts 40.

Although the corner posts 40 are shown and described in connection with a particular type of composite package, the corner posts are unique and may be equally suitable for use with a different type of package or without a complete package. They may merely be held against an appliance by one or more bands.

After the base member 8 and the side members 30 have been formed, the article A can be positioned on the base member and the side members positioned against opposite sides of the article. At this point, the remaining upper structure of the package can be formed around the article A.

As previously mentioned, the baseloid flanges 60 are secured to the upper ends of the corner posts at opposite sides of the package. In a similar manner, the inner panels 82 and 92 of a front stabilizer 80 and a rear baseloid flange 90 are adhesively secured to the front and rear surfaces, respectively, of the corner posts 40.

As best seen in FIG. 3, a door pad 70 may be positioned between the front of the appliance and the front corner posts.

Figure 11:
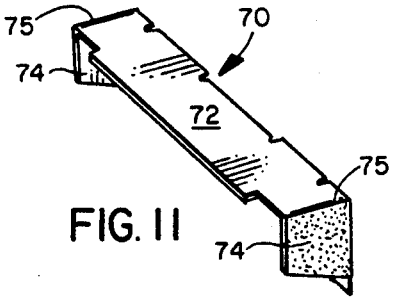
FIG. 11 is an isometric view of the door pad illustrated in the previous views.
Figure 12:
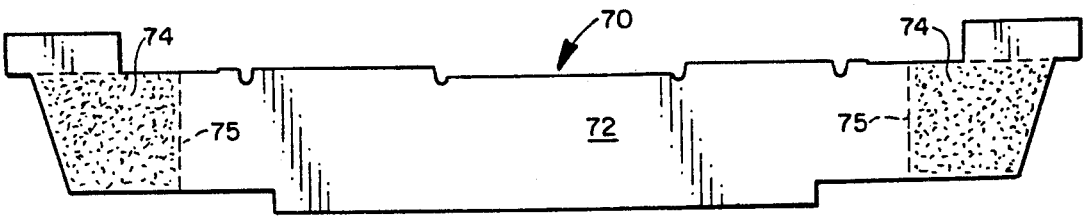
FIG. 12 is a plan view of a blank of sheet material from which the door pad illustrated in FIG. 11 may be formed.
Figure 14:
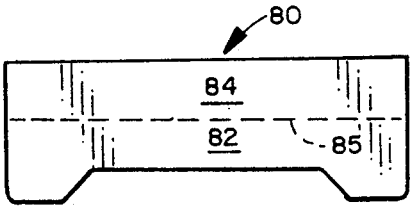
FIG. 14 is a plan view of the blank of sheet material from which the front stabilizer may be formed.

Although the posts are located between the corner posts and the appliance, they are not attached to the corner posts. The door pad 70, as best seen in FIGS. 11 and 12, includes a center panel 72 and a side panel 74 foldably joined to each other along a fold line 75.

In addition to the baseloid flanges and front stabilizer, the upper structure of the package includes a generally rectangular top cap 100 which comprises a center panel 102, having first and second pairs of inner panels 104 joined to its opposed pairs of side edges along fold lines 105, and one pair of outer panels 106, foldably joined along fold lines 107 to related edges of one pair of inner panels 104.

The top cap also includes a pair of relatively narrow glue panels 108, foldably joined along fold lines 109 to adjacent outer panels 106.

As best seen in FIG. 1, when the upper structure is formed, the outer panels of the baseloid flanges 60 and 90 and the outer panel of front stabilizer 80 are all folded outwardly 90 degrees to lie in a common horizontal plane.

Figure 16:
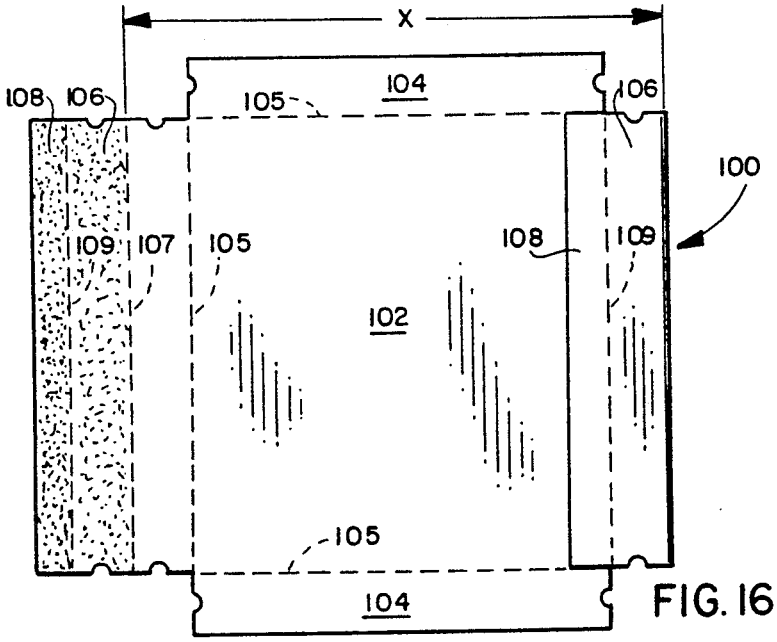
FIG. 16 is a plan view of a blank of sheet material from which the top cap illustrated in the other views may be formed, shown with one side of the cap partly assembled.
Figure 16A:
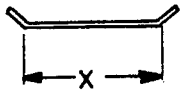
FIGS. 16A and 16B are end elevational views showing the folding sequence required to form the top cap from the blank.
Figure 16B:
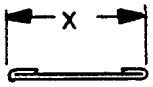

When the top cap is formed, as shown in FIGS. 16–16B, the glue panels 108 and related outer panels 106 of the top cap are folded 180 degrees about fold lines 107, whereby the outer panels overlie the inner panels, and the glue panels overlie the center panel.

At this point the top cap is placed over the corner posts and baseloid flanges, whereby the outer panels of the top cap overlie the outer panels of the baseloid flanges and front stabilizer and can be adhesively attached thereto.

After this has been done, the sides of the package are tightly wrapped with an outer layer F plastic film, which can be either stretch film or heat sealable film.

After the film has been wrapped around the sides of the paperboard components of the package, the outer panels of the top cap and related panels of the baseloid flanges and front stabilizer are folded downwardly against the outer surfaces of the film and corner posts.

The upper structure can then be completely encompassed by a band of strapping S to hold the components against each other and against the packaged article A.

There are, of course, between the outer and inner panels of the flanges, spaces adapted to receive a portion of a lifting device blade, so the package can be handled by conventional lifting equipment.

As previously mentioned, one of the primary features of the package is that it is designed and constructed to allow the packaged article A to be removed from the package and thereafter reinserted without destroying the integrity of the package.

Turning to FIG. 3, it will be seen that base member 8 may be secured to the lower portion of the packaged article by means of bolts B which extend through holes 13, 21, and 23 in the first and second sections of the base member.

After the package has been formed about the article A, as previously described, the bottom panels 52 of each of the bottom corner members can be folded inwardly and adhesively secured to the related bottom surfaces of base member first section center panel 12 and end panels 56 can be secured to the corner posts.

Thus, when it is desired to remove the article A from the package temporarily, the side and end panels of the bottom corner members are severed from the bottom panels, so the article can be pulled out of the package. This can be done either by lifting the package above the article, if it is in the vertical position, or placing the package on its back, as shown in FIG. 3, and pulling the article part way out of the package to allow the article to be altered or modified.

After the article has been modified, it can be reinserted into the package, and the side and end panels of the bottom corner members can be taped to the base member to secure the lower structure of the package. All this can be done without destroying the integrity of the upper portions of the package.

Also, it should be noted that, if it is desired to remove or alter leveling bolts of the article extending from the bottom of the article, the detachable tabs 58 may be detached and removed from bottom panels 54 of the bottom corner members to afford access thereto.

What is claimed is:

1. In a package for storing and shipping a relatively heavy article, a base member, comprising:

(a) a first section including:
  (i) a generally rectangular center panel;
  (ii) a pair of generally rectangular side panels foldably joined to opposed sides of said center panel;

(b) a pair of second sections each including:
  (i) a lower panel overlying an upper surface of said center panel adjacent one end thereof;
  (ii) an intermediate panel foldably joined at one side edge to one side edge of said lower panel and being disposed to overlie said lower panel;
  (iii) an upper panel having one side edge foldably joined to another side edge of said lower panel and being disposed to overlie said intermediate panel;

(c) said first section side panels being folded over 180 degrees and secured to upper surfaces of adjacent second section upper panels.

2. A package according claim 1, and including a plurality of corner posts positioned against outer corners of said packaged article, and wherein said base member is detachably connected to said corner posts by a pair of lower corner members.

3. A package according to claim 1, wherein each of said bottom corner members includes a side panel adapted to be secured to side surfaces of a pair of said corner posts and a bottom panel having a side edge foldably joined to a lower edge of said side panel and being disposed to underlie and be secured to a portion of said base member, and wherein said bottom corner member side and bottom panels are readily severable from each other, whereby said article, with said base member attached, can be readily removed from said package without destroying the integrity of any other portion of the package.

4. A package according to claim 2, wherein each of said corner posts is formed from a unitary blank of foldable sheet material, such as paperboard, and comprises:

(a) a pair of elongated, integral, hollow sections, each of which are generally rectangular in transverse cross-section;

(b) said sections being joined to each other along a longitudinal fold line and being disposed normal to each other to form an L-shaped structure adapted to lie against an outer corner of a packaged article.

5. A package according to claim 4, wherein each of said corner post sections includes:

(a) one outer panel having one side edge foldably joined to a side edge of an outer panel of the other section of said corner post;

(b) a first side panel having one side edge foldably joined to another side edge of said one outer panel;

(c) an inner panel having one side edge foldably joined to another side edge of said first side panel and being parallel to and co-extensive with said one outer panel;

(d) a second side panel having one side edge foldably joined to another side edge of said inner panel and being parallel to and co-extensive with said first side panel.

6. A package according claim 1, wherein said base member is positioned under said packaged article and removably secured thereto, and wherein said base member is detachably connected to corner posts by a pair of bottom corner members.

7. A composite package for storing and shipping a relatively heavy article, said package including a plurality of internal components formed primarily of foldable paperboard, and comprising:

(a) a plurality of vertically disposed corner posts;

(b) a lower structure including a base member and a pair of bottom corner members connecting said base member to lower ends of said corner posts;

(c) an upper structure attached to upper ends of said corner posts and including:

(i) at least one lifting flange extending between certain of said corner posts;

(ii) a cap covering portions of said corner posts and flange;

(d) a sheet of plastic film encompassing side surfaces of said upper and lower structures and said corner posts;

(e) strap means encompassing portions of said cap;

(f) said base member being arranged and disposed for attachment to a lower portion of said packaged article;

(g) said base member and said bottom corner members being arranged and disposed to accommodate the temporary removal of the article from the package and its reinsertion without destroying the integrity of any other portion of the package;

(h) said base member including a first section having:

(i) a generally rectangular center panel;

(ii) a pair of generally rectangular side panels foldably joined to opposed side edges of said center panel;

(i) said base member also including a pair of second sections each having:

(i) a lower panel overlying an upper surface of said center panel adjacent one end thereof;

(ii) an intermediate panel foldably joined at one side edge to one side edge of said lower panel and being disposed to overlie said lower panel;

(iii) an upper panel having one side edge foldably joined to another side edge of said lower panel and being disposed to overly said intermediate panel (j) said first section side panels being folded over 180 degrees and secured to upper surfaces of adjacent second section upper panels.

8. In a package for shipping and storing a relatively heavy article, a plurality of corner posts and means for retaining said corner posts against outer corners of a packaged article, said corner posts each being formed from a unitary blank of foldable paperboard, and comprising:

(a) a pair of elongated, integral, hollow sections, each of which are generally rectangular in transverse cross-section;

(b) said sections being joined to each other along a longitudinal fold line and being disposed normal to each other to form an L-shaped structure adapted to lie against an outer corner of a packaged article;

(c) a base member positioned under said packaged article and removably secured thereto, said base member being detachably connected to said corner posts by a pair of bottom corner members;

(d) said base member including a first section having:

(i) a generally rectangular center panel;

(ii) a pair of generally rectangular side panels foldably joined to opposed side edges of said center panel;

(e) said base member also including a pair of second sections each having:

(i) a lower panel overlying an upper surface of said center panel adjacent one end thereof;

(ii) an intermediate panel foldably joined at one side edge to one side edge of said lower panel and being disposed to overlie said lower panel;

(iii) an upper panel having one side edge foldably joined to another side edge of said lower panel and being disposed to overly said intermediate panel (f) said first section side panel being folded over 180 degrees and secured to upper surfaces of adjacent second section upper panels.

* * * * *